United States Patent [19]

Smith

[11] 4,240,344

[45] Dec. 23, 1980

[54] HIGH SPEED UNIT PRINTER AND INKER THEREFOR

[75] Inventor: Ruslon J. Smith, Moscow, Pa.

[73] Assignee: Equipment Technology Incorporated, Peckville, Pa.

[21] Appl. No.: 73,091

[22] Filed: Sep. 6, 1979

[51] Int. Cl.[3] ..... B41F 17/00

[52] U.S. Cl. ..... 101/44; 101/318; 101/335

[58] Field of Search ..... 101/41–44, 101/337, 338, 325, 319, 318, 311, 307, 302, 300, 293

[56] References Cited

U.S. PATENT DOCUMENTS

| | | | |
|---|---|---|---|
| 509,858 | 12/1893 | Anton . | |
| 1,411,679 | 4/1922 | Bright, Jr. | |
| 1,516,676 | 11/1924 | Mallory | 101/44 |
| 1,599,918 | 9/1926 | O'Hara | 101/41 |
| 1,600,025 | 9/1926 | Wegman | 101/41 X |
| 1,699,505 | 1/1929 | Nissen, Jr. | |
| 2,335,213 | 11/1943 | Lawrence | 101/41 |
| 2,437,224 | 3/1948 | Emerson | 101/41 |
| 2,450,656 | 10/1948 | Gowland | 101/3 |
| 2,571,638 | 10/1951 | Wells et al. | 101/335 |
| 3,593,661 | 7/1971 | Tripp | 101/40 X |
| 3,701,317 | 10/1972 | Miyamoto et al. | 101/41 X |
| 3,706,274 | 12/1972 | Coville | 101/333 |
| 3,756,146 | 9/1973 | Norwood | 101/44 |
| 3,910,183 | 10/1975 | Noren et al. | 101/41 |
| 3,916,784 | 11/1975 | Pubuit | 101/41 |
| 4,019,436 | 4/1977 | Handweiler et al. | 101/41 X |
| 4,152,984 | 5/1979 | Utzinger | 101/292 |

FOREIGN PATENT DOCUMENTS

| | | | |
|---|---|---|---|
| 736368 | 9/1955 | United Kingdom | 101/311 |
| 1456016 | 11/1976 | United Kingdom | 101/41 |

*Primary Examiner*—Clifford D. Crowder
*Attorney, Agent, or Firm*—Richard D. Weber

[57] ABSTRACT

A high speed unit printer comprising an intermittently rotating ink disc having a substantially horizontal surface on which a supply of ink is deposited. A collecting blade continuously directs the ink into a narrow stream near the periphery of the disc. An adjustable metering blade continuously spreads the ink stream from the collecting blade into a band of uniform thickness. An inking pad and a transfer pad are mounted on a common slide assembly which reciprocates to transfer ink from the disc to an adjacent plate or type, and an image from the plate or type to the article to be printed. The slide assembly is mounted on a pivotally mounted slide arm assembly which is raised during reciprocating movement of the slide assembly by a rotating cam.

14 Claims, 11 Drawing Figures

HIGH SPEED UNIT PRINTER AND INKER THEREFOR

BACKGROUND OF THE INVENTION

The present invention relates generally to printing or marking apparatus and relates more particularly to apparatus for automatically marking individual items or units of production passing along a conveyor at a rapid rate. The present device has particular application in the manufacture of electrical components such as capacitors which are manufactured in large quantity by automatic equipment and which must be accurately printed with the manufacturer's name or symbol, a product number and/or an indication of its electrical characteristics.

High speed production techniques in many fields of manufacture have necessitated the development of printing machines which are utilized primarily at the finishing stages of production to provide either decorative or informational marking to a product. To avoid product rejection and to prevent production delays, it is essential that the printing or marking device be reliable, easily adjusted and readily cleaned and resupplied with the marking fluid, normally some type of permanent printing ink.

A wide variety of devices have been developed and utilized in the past for the application of decorative and identifying markings. In some cases, the ink is applied to the platen or type bearing the decorative or identifying marking and this in turn is brought into direct contact with the unit or article to be marked. Such devices suffer the disadvantage that the surface irregularities of the article to be marked result in unpredictable ink transfer, causing not only a poorly marked article but also leaving undesirable amounts of surplus ink on the marking element. Further, the direct contact of the marking element with the articles results in a rapid wear of the element and a consequent deterioriation of the mark quality.

A more advantageous but also more complicated and expensive arrangement provides for an offset printing whereby the image is transferred from the plate or type to a resilient roll or pad and is then transferred to the production articles. With such a system, the transfer of ink is more predictable and accurate and the transfer roll or pad can be resilient in nature so as to conform with surface irregularities of the item to be marked.

In addition to difficulties in transferring the inked image from the plate or type to the unit to be marked, a major source of problems with marking equipment has been the difficulty of applying a uniform coating of ink to the plate or type. The typical arrangement for this purpose has comprised an ink reservoir within which an ink drum is rotated with the ink layer thereon being regulated by a doctor blade. The ink from the ink drum is conventionally transferred to the plate or type by a rubber roller. Equipment of this type suffers from leakage of ink around the drum and blade and is difficult to clean at the end of a printing operation. Attempts have been made to design marking systems without the usual drum and reservoir including systems employing a rotating ink disc. However, these systems have also suffered from difficulties in accurately metering the ink to permit a transfer of a predetermined ink quantity to the plate or type.

SUMMARY OF THE INVENTION

The present invention comprises a high speed unit printer characterized by an ink disc including means for accurately metering an ink layer of predetermined thickness onto a sector of the disc. This means includes a metering blade angularly inclined with respect to said disc and adjustable to vary the angle of inclination. A slot in the metering blade serves to meter ink disposed on the surface of the disc and the thickness of the ink layer can be effectively controlled by variation of the angle of inclination of the blade. A collecting blade engaging the ink disc to the rear of the metering blade serves to funnel ink on the disc into a narrow stream near the outer edge of the disc, which stream on reaching the metering blade is spread by the metering blade and applied in a uniform band of predetermined thickness to the disc surface.

An engraved plate or row of type bearing the mark or indicia to be printed is disposed adjacent the ink disc and means are provided for transferring ink from the ink disc to the plate or type, and then in a subsequent operation transferring the inked image to the individual units to be marked. In accordance with the present invention, a resilient inking pad and a resilient transfer pad are carried by a slide assembly which is reciprocated on a slide arm, alternately shuttling from a position wherein the inking pad and transfer pad are respectively over the ink disc and type, to a position wherein the inking pad and transfer pad are respectively over the type and unit to be marked. The drive linkage is arranged to provide a suitable pause at each end of the movement of the slide assembly, during which pause the slide arm is lowered to engage the inking pad and transfer pads respectively with either the ink disc and type face, or the type face and unit to be marked. The ink disc is intermittently rotated to present a fresh ink layer to the inking pad upon each engagement thereby.

Means are provided to prevent engagement of the inking pad and transfer pad with the ink disc or type face in the event an article is not present to be marked at the marking station.

The ink disc, metering blade and collecting blade are readily demountable for cleaning and may be quickly reassembled by unskilled workers. The slide arm rotates to expose the inking pad and transfer pad for cleaning as well as to permit cleaning or change of the plate or type bearing the mark or indicia to be reproduced.

It is accordingly a primary object of the present invention to provide a high speed unit printer which can function reliably for long periods of time with minimal attention.

A further object of the invention is to provide a unit printer as described wherein the ink supply elements thereof may be quickly disassembled for cleaning and which are characterized by essentially planar surfaces to simplify the cleanup operation.

Another object of the invention is to provide a unit printer as described which can be quickly set up and adjusted for printing operation and which does not require skilled technicians to oversee its operation.

A still further object of the invention is to provide a unit printer as described which is of a compact and relatively simple design and which can be economically manufactured.

Additional objects and advantages of the invention will be more readily apparent from the following description of a preferred embodiment thereof when taken together with the accompanying drawings.

DESCRIPTION OF THE PREFERRED EMBODIMENT

Figure 1:
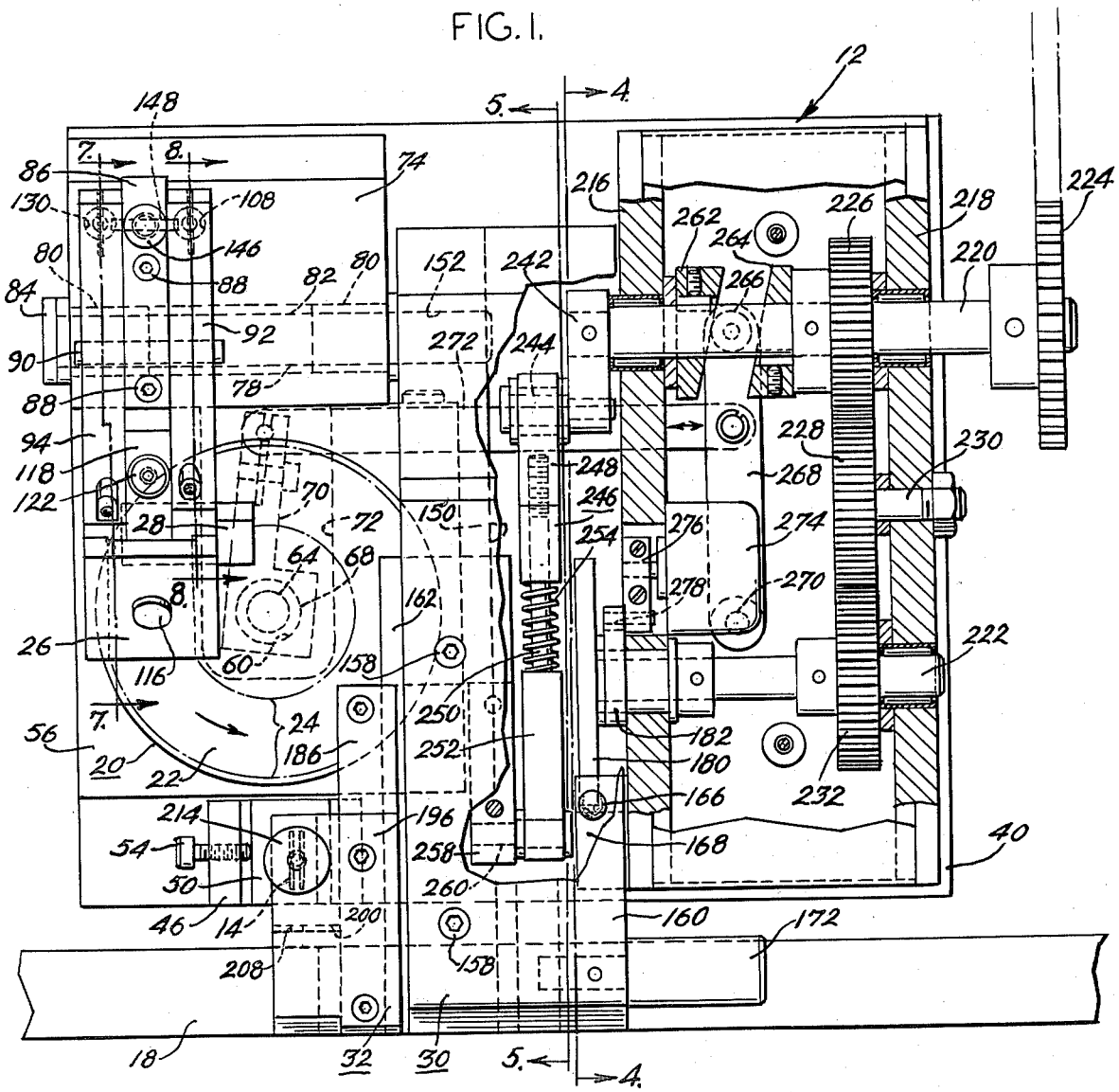
FIG. 1 is a plan view partially broken away and partially in section of a high speed unit printer embodying the present invention.
Figure 2:
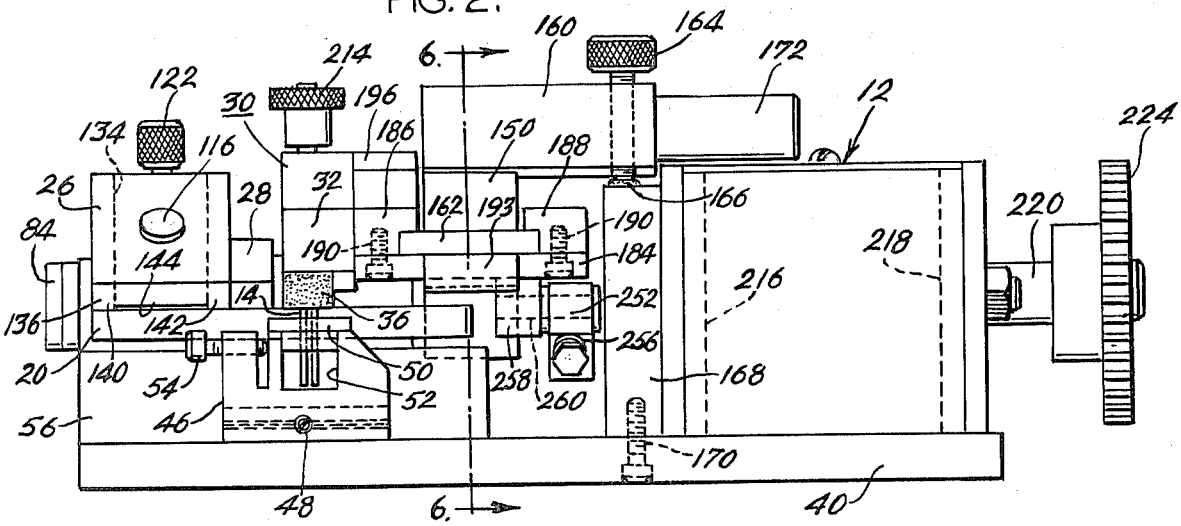
FIG. 2 is a front elevational view of the printer shown in FIG. 1.
Figure 3:
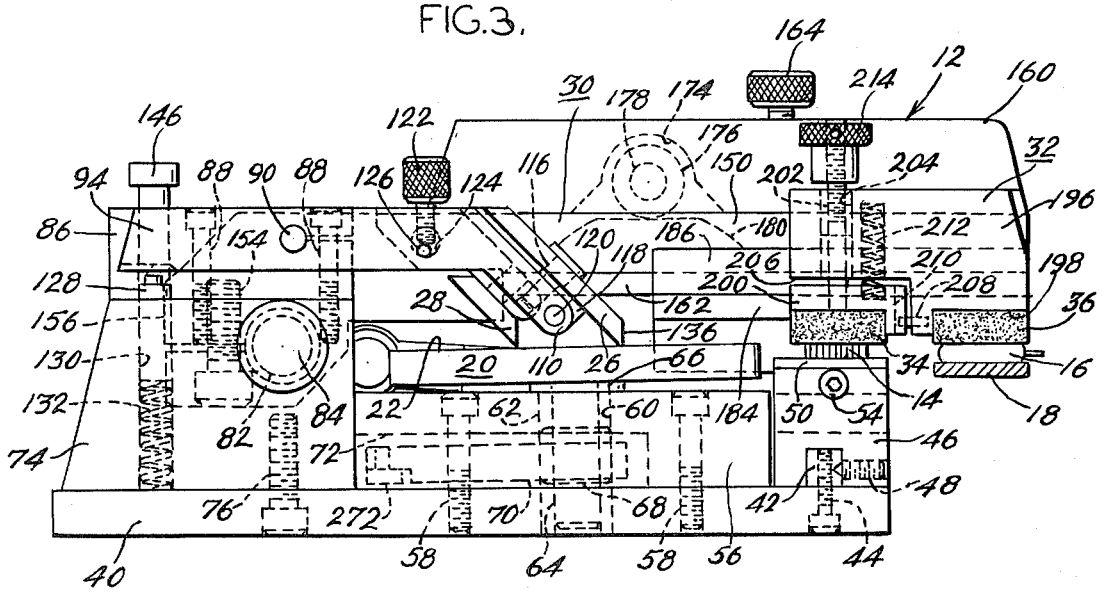
FIG. 3 is a left side elevational view of the printer shown in FIG. 1.

Referring to the drawings and particularly FIGS. 1–3 thereof, a preferred embodiment of the invention is illustrated in the form of a high speed unit printer generally designated 12. The function of the printer is to transfer an inked image from upwardly facing lines of type 14 to each of a series of units or articles 16 passing along in front of the printer on an intermittently advancing conveyor 18 as shown most clearly in FIGS. 1 and 3.

Prior to considering the details of the unit printer, a brief description of the salient features of the device will be provided so that the detailed description can be more readily understood.

A primary feature of the printer 12 is a substantially horizontal (although slightly inclined as described later) ink disc 20 having a planar upper surface 22 onto which a quantity of ink is manually applied. The ink disc 20 is intermittently rotated in a counterclockwise direction as viewed in the plan view of FIG. 1 and the ink is spread thereupon in a wide annular band 24 by the inclined metering blade 26 and collecting blade 28.

A slide arm assembly 30 disposed above and to one side of the ink disc 20 carries a slide assembly 32 thereon which is driven in recipricatory shuttle movement from a rearward position to a forward position with brief pauses at the end of each shuttle stroke. Resilient inking pad 34 and transfer pad 36 are carried by the slide assembly 32 and extend downwardly therebeneath in spaced relation. Means are provided to raise the slide arm assembly 30 during the shuttle movement of the slide assembly 32 and to lower the slide arm assembly for a brief period at each end of the shuttle movement so that the inking pad may engage the inked surface 22 of the ink disc and then move outwardly to engage and deposit ink upon the type 14, while at the same time the transfer pad 36 has picked up an image from the type 14 and transfers the image to the unit 16, the completion of the transfer step being shown in FIGS. 3 and 11. The elements of the printer 12 and its operation will now be described in detail.

The printer is supported by a rectangular base 40 which upon installation of the device is located in relation to the conveyor 18 such that the transfer pad 36 will be directly over the conveyed units 16 when the transfer pad is in its forward printing position. A rail 42 parallel with the front edge of the plate 40 and secured by screw 44 serves as a guide for a type carriage 46 which is secured with respect thereto in the desired location by means of locking screw 48. The type 14 is set in a type holder 50 which as viewed in FIG. 1 has a T-shaped section, the lower portion of which seats within a slot 52 in the type carriage 46. The type holder 50 is clamped in the desired position in slot 52 by the locking screw 54. The mechanism described thus serves as an adjustable vice for securing the type holder and type in a rigid manner at the front edge of the machine adjacent the conveyor belt 18 with the type facing upwardly.

Immediately to the rear of the carriage 46 an ink disc support block 56 is mounted on the base 40 by screws 58. A central bore 60 in the block 56 houses a bushing 62 within which an ink disc shaft 64 is rotatably disposed. The shaft 64 extends coaxially from the circular ink disc 20 and is axially slidable within the bushing 62 to permit removal of the disc and shaft for cleaning. The ink disc is supported on a flange portion 66 of the bushing 62 which extends above the support block 56. It will be noted that the bore 60 is not perpendicular with respect to the block 56 but is inclined rearwardly approximately one half degree with the result that the surface 22 of the ink disc 20 is rearwardly inclined to the same degree for a purpose which will be described in detail below.

To provide an intermittent rotation of the ink disc 20, the bushing 62 is interrupted to permit insertion of a one-way clutch 68 connected to a reciprocating crank arm 70 disposed in a slot 72 within the block 56. The crank arm 70 is driven in reciprocation in a manner later described thereby causing the incremental rotation of the shaft 64 and attached ink disc 20 in a counterclockwise direction as viewed from above.

Immediately to the rear of the block 56, a slide arm bearing block 74 is secured to the base 40 by screws 76. The bearing block 74 includes a horizontal bore 78 passing therethrough and containing at each end thereof bushings 80 which pivotally support a slide arm shaft 82 having a flat head 84 at the outer end thereof and extending substantially beyond the block 74 at the inner end thereof for attachment to the slide arm assembly 30 as described below.

Figure 8:
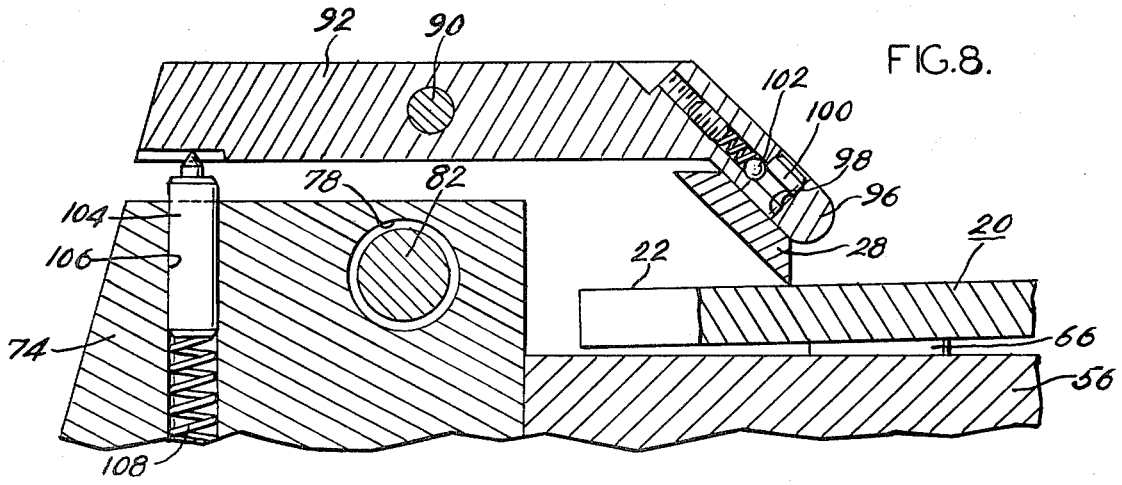
FIG. 8 is an enlarged sectional view taken along line 8—8 of FIG. 1.

The bearing block 74 also serves to support the metering blade 26 and the collecting blade 28. The support means for these blades comprises an upstanding elongated support member 86 secured to the upper surface of the block 74 by screws 88. A pivot pin 90 extending transversely through and to each side of the support member 86 serves to pivotally support a collector blade support arm 92 on the inner side of member 86, and a metering blade support arm 94 on the outer side of the support member 86. As shown in detail in FIG. 8, the support arm 92 includes a downwardly angled nose portion 96 having a bore 98 therein within which a mounting pin 100 attached to the collecting blade 28 is removably secured by means of the spring loaded ball detent 102 in engagement with a groove in the pin 100. This arrangement permits the collecting blade to be snapped from the support arm 92 for cleaning, servicing or replacement. The support arm 92 is spring loaded to urge the collecting blade 28 into engagement with the ink disc surface 22 by engagement with a spring follower 104 disposed within a bore 106 of the bearing block 74 and urged upwardly by the compression spring 108 in the lower end of the bore.

Figure 7:
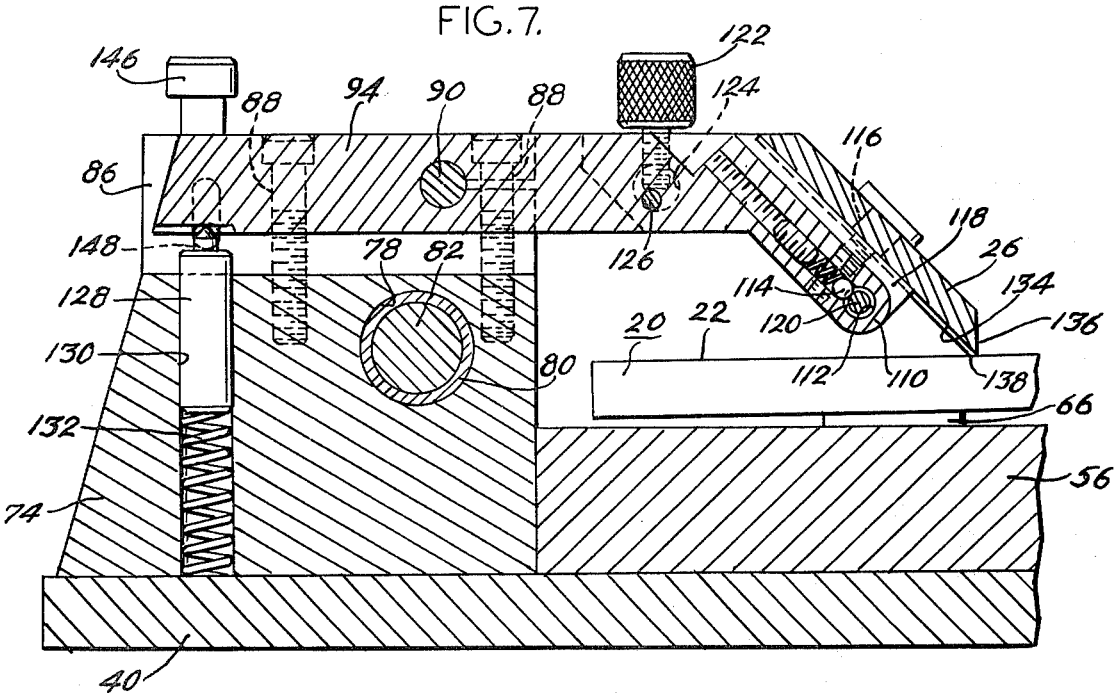
FIG. 7 is an enlarged sectional view taken along line 7—7 of FIG. 1.

As shown in FIG. 7, the support arm 94 includes a nose portion 110 having a transverse bore 112 in the lower end thereof into which a spring loaded ball detent 114 protrudes. The metering blade 26 is pivotally mounted by means of pin 116 to a blade adjustment arm 118 having a transverse pivot shaft 120 adapted to seat within the bore 112 of the nose portion 110. A groove in the shaft 120 is engaged by the ball detent 114 to secure the metering blade in the correct transverse position with respect to the support arm 94. An adjusting screw 122 in the rear portion of the arm 118 extends into a transverse bore 124 in the arm 118 to engage a pin 126 extending laterally thereinto from the support arm 94. By adjustment of the screw 122, the angle of the metering blade 26 may be adjusted through a predetermined range limited by the size of the bore 124. In the position of the adjusting screw 122 shown in FIG. 7, the metering blade 26 is at its maximum angular setting with respect to the ink disc surface 22.

To facilitate the cleaning, maintenance or replacement of the metering blade 26, the blade and the adjustment arm 118 may be quickly removed from the support arm 94 by transversely pulling the shaft 120 from the bore 112 to overcome the retaining force of the ball detent 114.

In a manner similar to that of support arm 92, the support arm 94 is biased in a clockwise direction as viewed in FIG. 7 by the spring follower 128 slideably disposed in a bore 130 of the block 74 and urged upwardly by the compression spring 132 disposed therebeneath.

The metering blade 26 includes a groove 134 in the back face thereof, the width of the groove being equal to the width of the ink band 24. The lower edge of the blade 26 has a bevelled surface 136 angled at approximately 45° to the planar blade surfaces, and a narrow reverse bevel 138 substantially perpendicular to the bevelled surface 136. The bevelled surface 138 partially interrupted by the groove 134 serves to form a pair of feet 140 and 142 which engage the surface 22 of the ink disc 20. As best shown in FIG. 2, the feet 140 and 142 and the groove 134 establish in conjunction with the ink disc surface 22 a metering slot 144 therebetween, the depth of which governs the thickness of the ink layer metered onto the ink disc surface 22. It can accordingly be appreciated that a variation in the angle of the metering blade 26 by means of the adjusting screw 122 will alter the depth of the slot 144. For example, the adjustment of screw 122 to permit a smaller angle of the metering blade 26 with respect to the ink disc 20 will cause the feet 140 and 142 to rock back on their heels and thereby increase the depth of the slot 144 and produce a thicker layer of ink on the ink disc surface 22. Conversely, an increase in the angle of the metering blade 26 with respect to the ink disc will produce a corresponding decrease in the depth of the slot 144 and of the thickness of the ink metered onto the ink disc surface.

To permit the convenient removal of the support arms 92 and 94 from the shaft 90, a pushrod 146 is vertically slideably disposed within a bore at the rear of support member 86. A transverse pin 148 on the pushrod extending through slots in the member 86 is adapted to engage the spring followers 104 and 128 to simultaneously depress the spring followers upon depression of the push rod.

Figure 6:
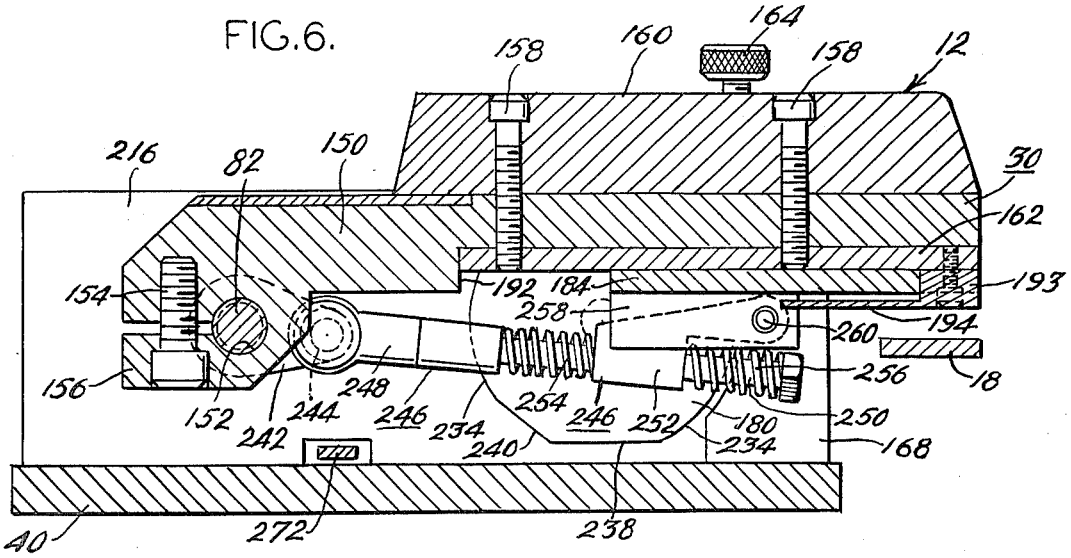
FIG. 6 is a sectional view taken along line 6—6 of FIG. 2.

The slide arm assembly 30 includes a main arm member 150 having a transverse bore 152 therein through which passes the shaft 84. A screw 154 joining the bifurcated back end 156 of the arm 150 locks the arm onto the shaft 152. As shown in FIGS. 3 and 6, the arm 150 extends well forward of the base 40 so as to overlie the conveyor.

Secured to the arm member 150 by screws 158 are an overlying cap member 160 and an underlying slide element 162. Cap member 160 as shown in FIG. 2 extends well beyond the right hand edge of the arm member 150 and carries an adjusting screw 164 which is threadedly engaged in a vertical bore passing therethrough. The adjusting screw 164 extends through the cap member 160 and in the lowered position of the slide arm assembly engages a stop pad 166 on post 168 secured to base 40 by screw 170. The adjustment of the screw 164 will control the engagement pressure of the transfer pad 36 with the type 14 and article 16 to be printed. A handle 172 provides a convenient grip for rotating the entire slide arm assembly into the vertical position to permit the ready removal of the ink disc for cleaning and also to permit access to the type holder as well as the inking and transfer pads.

Figure 4:
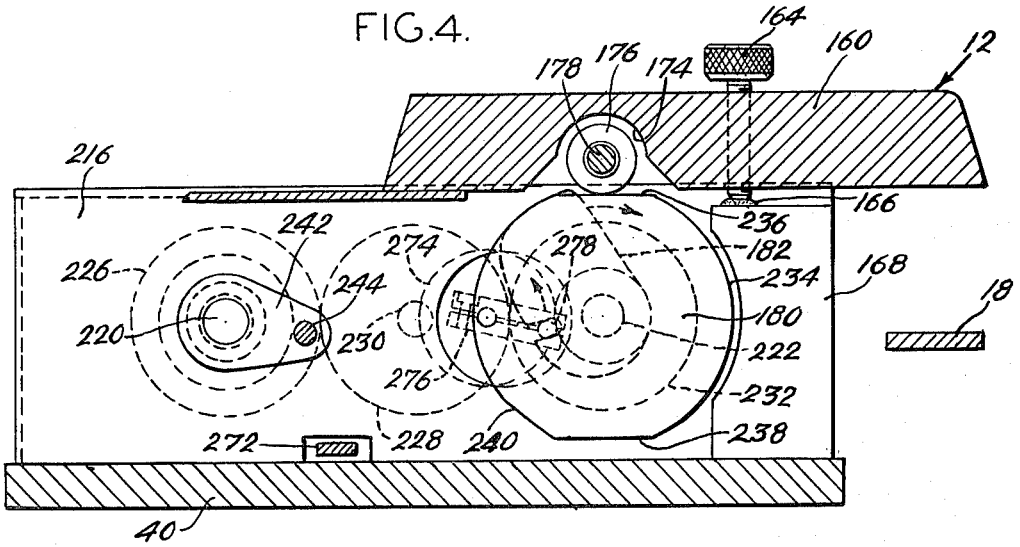
FIG. 4 is a sectional view taken along line 4—4 of FIG. 1.
Figure 5:
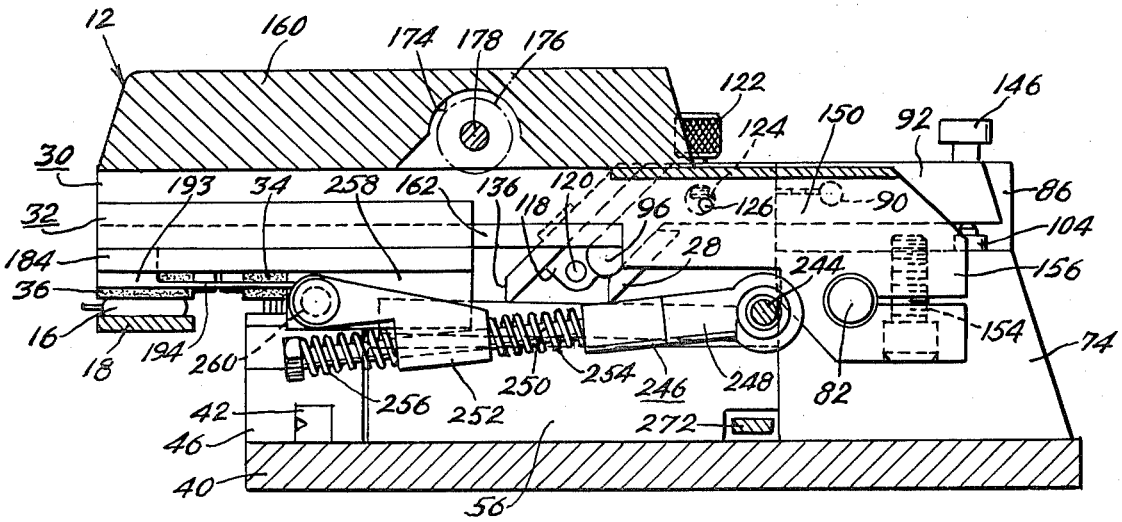
FIG. 5 is a sectional view taken along line 5—5 of FIG. 1.

As shown most clearly in FIG. 4, the cap member 160 is cut away at 174 to provide a housing for a cam follower 176 rotatably mounted on a stub shaft 178 secured to the cap member. The cam follower 176 is disposed above and of sufficient width to be engaged by either the cam 180 or the coaxial auxiliary cam 182, the details of which are described below.

The slide assembly 32 comprises a slide plate 184 slideably supported beneath the slide element 162 by parallel rail members 186 and 188 which are grooved to receive the slide element and which are secured to the slide plate 184 by screws 190. The travel of the slide assembly 32 along the slide element 162 is limited by the shoulder 192 of the arm member 150 at the back end of the slide element 162, and the stop member 193 mounted at the front end of the slide element 162. An inwardly extending portion 194 of the stop member 193 serves as a guard to prevent pinching injuries during reciprocation of the slide assembly against the stop member 193.

Figure 10:
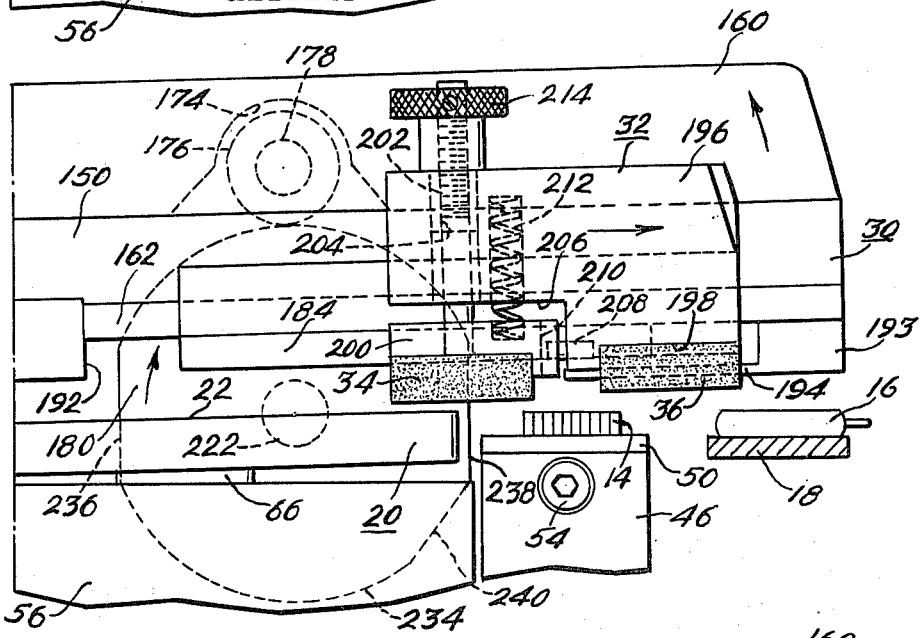
FIG. 10 is a view similar to FIG. 9 showing the inking pad and transfer pad in the raised position during outward movement along the slide arm.

A pad support block 196 is mounted on the left side of the slide assembly 32, being secured to the rail member 186. The resilient transfer pad 36 is secured within a recess 198 of the block 196 and extends downwardly below the lower surface of the block. The resilient inking pad 34 is mounted on a pad carrier 200 attached to a vertical shaft 202 which is vertically slideable within a bore 204 of the block 196. As shown in FIG. 3, the carrier 200 is disposed substantially within a recess 206 of the block 196 and is maintained in alignment by a pin 208 extending rearwardly from the block 196 and travelling in a slot 210 of the carrier 200. A compression spring 212 disposed primarily within a bore within the block 196 urges the carrier 200 in a downward direction. The limit of downward travel of the carrier 200 and the attached inking pad 34 is controlled by adjusting screw 214 threadedly engaged with the upper end of the shaft 202. As shown in FIG. 10, the engagement of adjusting screw 214 with the upper surface of the block 196 limits the downward travel of the carrier 200 and the inking pad 34.

The drive mechanism for rotating the ink disc 20, reciprocating the slide assembly 32 and rotating the cam 180 to provide a pivotal movement of the slide arm assembly 30 in a coordinated manner is illustrated in FIG. 1. Inner and outer parallel bearing plates 216 and 218 mounted vertically on the base 40 and extending from the front to rear thereof support therebetween in suitable bearings a drive shaft 220 and cam shaft 222. An outwardly extending end of the drive shaft 220 carries a drive sprocket 224 to which the power input to the marking device is applied either by way of a direct motor connection or by a drive belt or gearing connection to the power train of the other machines on the assembly line.

Figure 9:
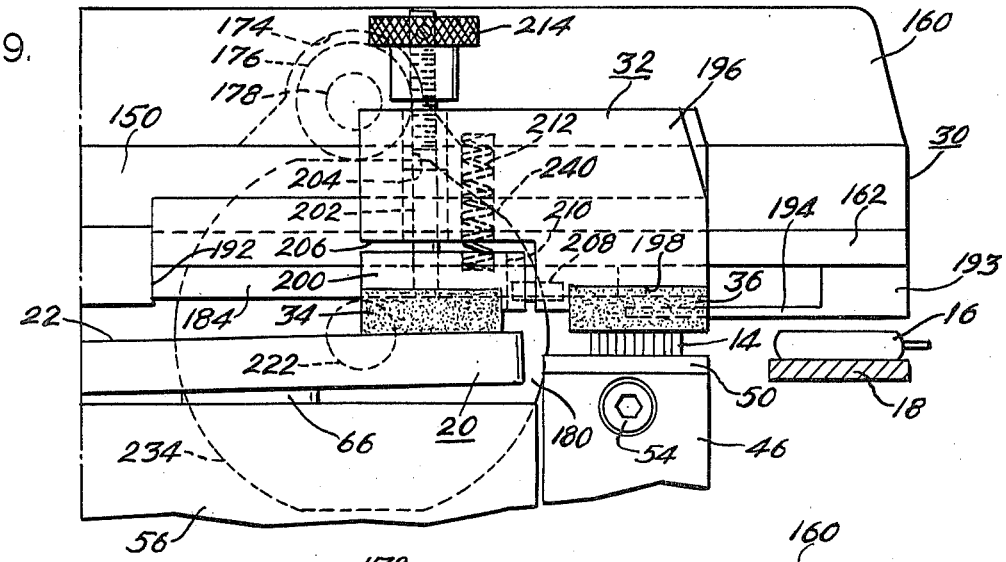
FIG. 9 is an enlarged partial left side elevational view of the unit printer of FIGS. 1–8 showing the inking pad and transfer pad respectively in engagement with the ink disc and type.
Figure 11:
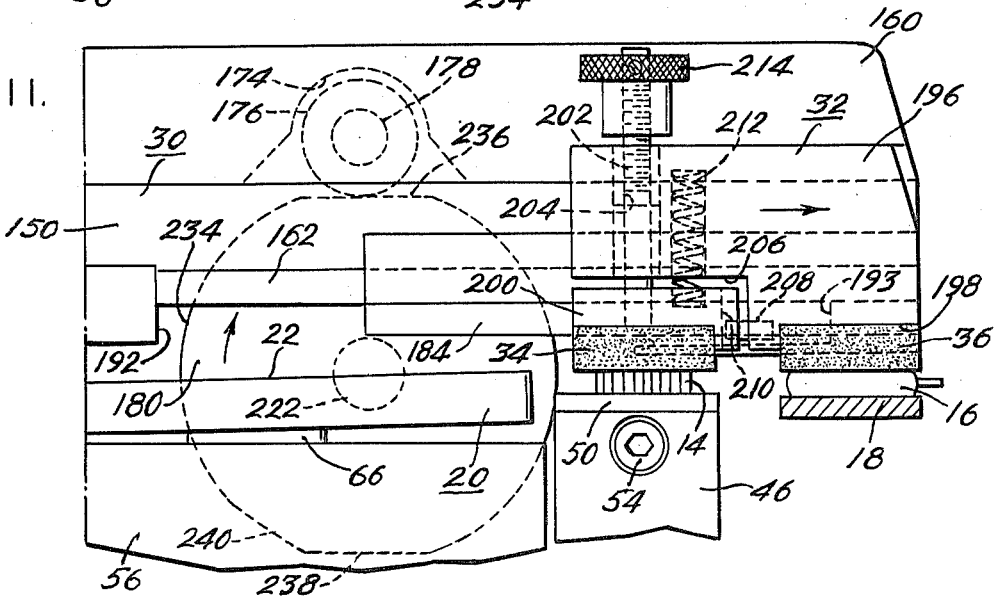
FIG. 11 is a view similar to FIGS. 9 and 10 showing the inking pad and the transfer pad respectively in engagement with the type and the unit to be marked.

A drive gear 226 on the drive shaft 220 meshes with an idler gear 228 on stub shaft 230 extending from the bearing plate 218. The idler gear 228 in turn engages the driven gear 232 on the cam shaft 222 to produce a rotation of the cam shaft at the same rate and in the same direction as the drive shaft. The inner end of the cam shaft carries the cam 180 which as shown in FIG. 4 has a peripheral camming surface 234 of a circular configuration interrupted by a pair of flats 236 and 238 opposed at 180°. The circular configuration of the cam surface 234 is further interrupted by a flat portion 240 just preceding the flat 238. As shown in FIGS. 9 and 11, the flats 236 and 238 permit the cam follower 176 and the slide arm assembly to drop down to a level controlled by the adjusting screw 164 at the inner and outer limits of the travel of the slide assembly 32. As shown in FIG. 10, when the cam follower 176 engages the circular portion of the camming surface 234, the slide arm assembly is raised to lift the inking pad 34 and transfer pad 36 from engagement with either the ink disc 20, type 14 or article 16, during the reciprocatory movement of the slide assembly 32.

The flat portion 240, which is shallower than the flats 236 and 238, provides a dipping movement of the slide arm assembly just before the slide assembly 32 reaches its rearward limit. This dip permits the inking pad 34 to momentarily engage the ink disc surface 22 while the slide assembly is still moving inwardly. This results, in conjunction with the inward inclination of the surface 22 of approximately ½°, in a squeegying action of the inking pad across the ink band 24 to effect a more uniform ink distribution across the inking pad and overcome any difficiencies in the ink distribution which might be caused by dust particles catching in the ink metering slot 144. The shallowness of the flat portion 240 of the camming surface 234 prevents the transfer pad 36 from engaging the type 34 during the dipping movement of the slide arm assembly. The inking pad by virtue of its spring loaded suspension extends downwardly slightly below the transfer pad 32 as can be seen in FIG. 10 and accordingly can engage the ink disc in a wiping motion while the transfer pad remains clear of contact with the type 14.

The slide assembly 32 is driven in reciprocation by a crank 242 attached to the inner end of the crank shaft 220. Pivotally attached to the crank 242 on pivot pin 244 is a connecting rod assembly 246 comprising a connecting arm 248 pivoted on the pin 244, a connecting bolt 250 extending outwardly from the arm 248, a connecting element 252 slideable on the bolt 250, and compression coil springs 254 and 256 at either side of the connecting element 252. The connecting element 252 is pivotally attached at its outer end to an attachment block 258 by means of pivot pin 260 extending therefrom.

The rotation of the drive shaft 220 will, by means of the crank 242, produce a reciprocating movement of the connecting rod assembly 246. The provision of the connecting element 252 slideable on the bolt 250 and spring biassed by the opposed compression springs 254 and 256 permits the slide assembly 32 to pause at each end of its stroke. The stroke of the slide assembly and attached connector element 252 is less than that of the connecting rod assembly 246 as permitted by the compression springs which are essentially a lost motion arrangement. The slide assembly 32 will accordingly move against either the shoulder 192 or the stop member 193 at the end of each stroke and pause momentarily before returning in the opposite direction.

The crank arm 70 is also reciprocated by a drive mechanism driven by the drive shaft 220. This mechanism comprises a pair of spaced opposed cam plates 262 and 264 on the drive shaft 220 acting on a cam follower 266 of a cam follower arm 268 pivoted on the base 40 at 270 to provide a reciprocating movement of the cam follower arm. A connecting link 272 is pivotally connected between cam follower arm 268 and the crank arm 70 to effect a reciprocating motion of the crank arm 70 and hence by means of the clutch 68, an intermittent rotation of the ink disc 20. The movement of the ink disc 20 is coordinated with the reciprocation of the slide assembly 32 and the lifting movements of the cam 180 since all three are driven by the same drive shaft and mechanically linked thereto.

The auxiliary cam 182 is pivotally mounted on the cam shaft 222 adjacent the cam shaft 180 and is rotated approximately 45° to engage the cam follower 176 and lift the slide arm assembly into its raised position in those instances in which there is no article present on the conveyor to be marked. The auxiliary cam 182 is rotated by a rotary solenoid 274 acting through a crank 276 connected to the auxiliary cam by means of a pin and slot connection 278 as shown in FIG. 4. The solenoid 274 may be manually actuated such as by a foot pedal when an operator visually confirms the absence of a unit to be marked, or a detector means such as a photocell may be employed to automatically actuate the auxiliary cam when an empty spot on the conveyor is detected.

For operation, the printer 12 is installed in a position such that the transfer pad 36 will overlie and engage the articles to be marked in the manner shown in FIG. 3 during the printing cycle of the operation. The drive sprocket 224 is connected with suitable drive means which as indicated above may be a common drive with other apparatus of a production line. With the slide arm assembly 30 pivoted 90° about its shaft 82, the type 14 is placed in position and the type carriage 46 adjusted to secure the type in its desired alignment.

Ink is manually applied to the ink disc surface 22 in a quantity sufficient to produce a full band 24 of ink on the surface by action of the collecting and metering blades. The thickness of the ink band is adjusted as desired by means of the adjusting screw 122.

With the slide arm assembly lowered into its operating position shown in the drawings, the operation of the device is fully automatic upon application of a drive means to the drive shaft 220. An initial adjustment may be required of the adjusting screw 164 to control the pressure of application of the transfer pad 36 to the articles 16 to be marked. Similarly, the adjusting screw 214 may require adjustment to limit the downward travel of the inking pad 34.

Upon making the adjustments referred to above, the printer will function without attention to mark each article 16 as it passes on the conveyor 18. It will be evident that an intermittent motion of the conveyor will be required to momentarily stop each article beneath the transfer pad while the transfer pad engages the article to transfer the image thereto.

The sequence of the operating cycle is most clearly illustrated in the enlarged and somewhat schematic views of FIGS. 9–11. In FIG. 9, the cam 180 is in a position wherein the flat 238 is uppermost, permitting the cam follower 176 and the slide arm assembly 30 supported thereby to drop into its lowered position. At this point, the slide assembly 32 is located in its rearward position against the shoulder 192 and the inking pad accordingly engages the inking disc surface 22 while the transfer pad engages the type 14.

As shown in FIG. 10, the continuing rotation of the cam lifts the slide arm assembly and the inking and transfer pads from the ink disc and type surfaces as the slide assembly moves toward its forward or printing position. The printing position is illustrated in FIG. 11 wherein the slide assembly has reached its forward position against stop member 193 and the cam follower is bearing against the flat 236 resulting in a lowering of the inking pad onto the type and of the transfer pad onto the article to be marked. As described above, there is a sufficient pause in the reciprocating movement of the slide assembly to permit the contact of the transfer pad with the article to be marked without smearing the image.

As indicated above, the drive arrangement for the ink disc, slide arm assembly and slide assembly are coordinated such that the ink disc is stopped during engagement by the inking pad 34. The flat portion 240 of the cam permits a preliminary wiping motion of the inking pad across the ink disc just prior to the full downward movement of the pads during which the inked impression is picked up by the transfer pad. The slight inclination of the ink disc causes the trailing edge of the inking pad to engage the disc surface first, thereby producing a squeegee action on the ink caught between the ink disc and inking pad surfaces.

It has been found that the ink disc will hold an ink supply adequate for an eight hour shift with the device marking at the rate of two articles per second. A certain amount of ink will be dammed up behind the metering blade to provide a continuing supply behind the metering slot. The edge of the metering blade adjacent the ink disc is offset in the direction of disc rotation from a radius of the disc parallel to the blade edge and accordingly the narrow stream of ink produced by the collecting blade will be carried into the metering blade at an angle to the edge of the metering blade and the stream flow will accordingly move inwardly along the metering blade edge to completely supply the full width of the metering blade.

Upon completion of a marking run or at the end of a working shift, the ink engaging elements of the printer may be quickly removed for cleaning. The slide arm assembly 30 is raised to a vertical position, and the type face and inking and transfer pads may be quickly wiped clean. By depressing the push rod 146, the support arms 92 and 94 may be pulled from the pivot pin 90 and the collecting blade and the metering blade may be respectably snapped from their respective arms for cleaning. The ink disk and its shaft 64 may be simply lifted out for cleaning. The reassembly of these parts may be quickly effected to permit resumption of the printing process.

In the event of an interruption of the flow of articles to be marked, the solenoid 274 is actuated either manually or by an automatic control to raise the auxilary cam 182 into a vertical position, thereby lifting the cam follower 176 and the attached slide arm assembly to prevent the inking pad and transfer pad from engaging the ink disc or the type.

Manifestly, changes in details of construction can be effected by those skilled in the art without departing from the spirit and scope of the invention.

I claim:

1. A high speed unit printer comprising a base, an ink disc mounted on said base and having a substantially horizontal disc surface, means for intermittently rotating said disc, a metering blade engaged with said disc surface, said metering blade having a slot in the disc-engaging edge thereof through which ink is metered in a band of uniform thickness, a collecting blade in engagement with said disc surface for diverting ink on said disc surface into a narrow stream, means for supporting a plate or type in a face-up relation adjacent said disc, a resilient inking pad and a resilient transfer pad, means supporting said inking pad and transfer pad in spaced relation, and means for cyclicly moving said pad supporting means from a first position wherein said inking pad engages said ink disc and said transfer pad engages said plate or type to a second position wherein said inking pad engages said plate or type and said transfer pad engages an article to be marked.

2. The invention as claimed in claim 1 wherein said metering blade comprises a groove in the back face thereof and wherein said edge engaging said ink disc is bevelled to produce said metering slot.

3. The invention as claimed in claim 2 wherein said metering blade is inclined at an angle to said ink disc surface, and wherein said angle is adjustable to vary the size of said metering slot and to accordingly change the thickness of the band of ink on said ink disc surface.

4. The invention as claimed in claim 1 wherein said metering blade and collecting blade are spring-biased against said ink disc surface.

5. The invention as claimed in claim 1 wherein said ink disc is slightly inclined with respect to the engaging surface of said inking pad and wherein said inking pad engages said ink disc surface prior to completion of its reciprocatory motion to effect a squeegee action on ink between the ink disc surface and the inking pad.

6. The invention as claimed in claim 1 wherein the movement of said means carrying said inking pad and said transfer pad is essentially vertical during engagement of said transfer pad with said plate or type and with said article to be printed.

7. The invention as claimed in claim 1 wherein said inking pad engages said ink disc surface between the periods of intermittent rotation thereof.

8. The invention as claimed in claim 1 wherein said inking pad and said transfer pad are mounted on a slide assembly, said slide assembly being mounted on a slide arm assembly, means for reciprocating said slide assembly and providing pauses in the reciprocatory movement at the end points of each stroke thereof, said slide arm assembly being pivotally mounted, and means for lowering said slide arm assembly during the pauses in the reciprocatory movement of said slide assembly to permit said inking pad and transfer pad to engage the ink disc, plate or type, and the article to be marked.

9. The invention as claimed in claim 8 wherein said inking pad is resiliently mounted on said slide assembly and extends downwardly below said transfer pad in the raised position of said slide arm assembly.

10. The invention as claimed in claim 9 wherein said slide arm assembly is raised and lowered by a rotating cam of generally circular configuration.

11. The invention as claimed in claim 10 wherein said cam includes a pair of diametrically opposed flats thereon to provide a lowering of said slide arm assembly at the ends of the reciprocatory strokes of said slide assembly.

12. The invention as claimed in claim 11 wherein said cam includes a flat portion just preceding the flat thereon corresponding to the lowered position of said slide arm assembly producing engagement of said inking pad with said inking disc surface, said flat portion producing a preliminary wiping contact of said inking pad with said disc surface prior to the end of the reciprocatory stroke of said slide assembly.

13. The invention as claimed in claim 10 including an auxilary cam for holding said slide arm assembly in the raised position, and means for selectively actuating said auxilary cam.

14. The invention as claimed in claim 1 including conveyor means underlying said transfer pad in the printing position thereof for conveying articles to be printed to and from the transfer pad.

* * * * *